US006394583B1

(12) United States Patent
Mace et al.

(10) Patent No.: US 6,394,583 B1
(45) Date of Patent: May 28, 2002

(54) ELECTRICAL APPARATUS FOR EJECTING MATERIAL FROM A LIQUID

(75) Inventors: Daniel Richard Mace; Philip Atkin; Richard Wilhelm Janse Van Rensburg; John Teape; Neil Emerton; Guy Charles Fernley Newcombe, all of Cambridge (GB)

(73) Assignee: Tonejet Corporation Pty Ltd., Eastwood (AU)

( * ) Notice: Subject to any disclaimer, the term of this patent is extended or adjusted under 35 U.S.C. 154(b) by 0 days.

(21) Appl. No.: 09/331,442

(22) PCT Filed: Jan. 22, 1998

(86) PCT No.: PCT/GB98/00191

§ 371 (c)(1),
(2), (4) Date: Jun. 22, 1999

(87) PCT Pub. No.: WO98/32609

PCT Pub. Date: Jul. 30, 1998

(30) Foreign Application Priority Data

Jan. 22, 1997 (GB) ..... 9701318

(51) Int. Cl.[7] ..... B41J 2/04
(52) U.S. Cl. ..... 347/54
(58) Field of Search ..... 347/68, 69, 70, 347/71, 72, 50, 40, 54, 20, 44, 47, 27, 63; 399/261; 361/700; 310/328–330; 29/890.1

(56) References Cited

U.S. PATENT DOCUMENTS 4,396,925 A 8/1983 Kohashi

FOREIGN PATENT DOCUMENTS

| | | |
|---|---|---|
| EP | 0 046 295 | 2/1982 |
| EP | 0 703 080 | 3/1996 |
| EP | 0 703 081 | 3/1996 |
| EP | 0 750 989 | 1/1997 |

*Primary Examiner*—Raquel Yvette Gordon
(74) *Attorney, Agent, or Firm*—Dykema Gossett PLLC

(57) ABSTRACT

There is disclosed an ejection apparatus for ejecting material from a fluid. An ejection cell (5) contains fluid from which the material is to be ejected and has an ejection upstand (6) which defines a location from which the material is ejected. One or more ejection electrodes (9) are disposed in the cell substantially surrounding the ejection upstand (6).

20 Claims, 3 Drawing Sheets

ELECTRICAL APPARATUS FOR EJECTING MATERIAL FROM A LIQUID

The present invention relates to apparatus for ejecting material from a liquid. More particularly, the method and apparatus employed may be generally of the type described in WO-A-93-11866, WO-A-94-18011 and WO-A-95-32864, the disclosure of which is incorporated herein by reference. In the methods described in these patent applications an agglomeration or concentration of particles is achieved at an ejection location and from the ejection location particles are then ejected onto a substrate, e.g. for printing purposes. In the case of an array printer, plural cells each containing an ejection location may be arranged in one or more rows.

The present invention is directed towards novel constructions of such apparatus to improve operation and enhance operability, some of which were also disclosed, for the first time on the priority date of the present application, in FIGS. 4 to 6 of WO-A-97-27058, the disclosure of which is also incorporated herein by reference. Reference is also made to our WO-A-97-27056, WO-A-97-27057, and WO-A-97-27060.

EP-A-0703081, EP-A-0046295 & U.S. Pat. No. 4396925 disclose ejection apparatuses which include projecting electrodes which act to cause ejection of liquid from the apparatus.

According to a first aspect of the present invention there is provided an ejection apparatus for ejecting material from a fluid, the apparatus comprising an ejection cell for containing fluid from which the material is to be ejected, the cell having a single ejection upstand formed of a dielectric material and extending outwardly of the cell and defining a location from which the material is ejected, and one or more ejection electrodes disposed in the cell substantially surrounding the ejection upstand.

The term 'substantially surrounding' is preferably used in the context of this application, to mean that the ejection electrode or electrodes extend around at least 50% of the periphery of the ejection upstand, but, preferably, the ejection electrodes extend around a greater part of the periphery in order to surround the ejection upstand to the greatest extent possible.

Preferably, the ejection electrode, which may be single or multi-part, extends substantially completely around the ejection upstand.

According to a second aspect of the invention there is provided an ejection apparatus for ejecting material from a fluid, the apparatus comprising an ejection cell for containing fluid from which the material is to be ejected, the cell having an ejection upstand formed of a dielectric material and extending outwardly of the cell and defining a location from which the material is ejected, and a pair of ejection electrodes, one disposed on each side of the ejection upstand. The ejection electrodes are electrically connected so as to provide the same voltages in use.

The ejection upstand, which in use pins a fluid meniscus at the outer extremity of the cell, may take one of a number of different forms, for example comprising a corner of a separator which at least partially divides the cell into two halves, one on each side of the separator. In such case, the separator may be substantially planar (or plate-like) and plural cells may be arranged in closely spaced alignment, each cell being separated from its neighbors by a pair of second plate-like separators, one on each side. Each second separator is thus common to the adjacent cells and alternate separators are used to form the ejection upstands. Preferably, the second separators do not project outwardly of the cells, but rather define the outer boundaries of the cells, through which the ejection upstands project. The 'stack' of plate-like separators thus define a row of ejection cells having ejection upstands at one corner and the side edges of the cells may be closed by cover plates suitably positioned.

The ejection electrodes may comprise multi-part electrodes, a first part being disposed on a face of the ejection upstand and a second part on the opposing face of the adjacent separator.

The cover plates may themselves constitute additional or secondary electrodes to enhance the electric field around the ejection upstands.

Providing the cells with separators and electrodes as described above provides shielding for the ejection location from the voltages applied to the electrodes of adjacent cells and fluidic isolation for the ejection location when ejection voltages are applied to the electrodes of adjacent cells.

Examples of apparatus according to the present invention will now be described with reference to the accompanying drawings, in which.

Figure 1:
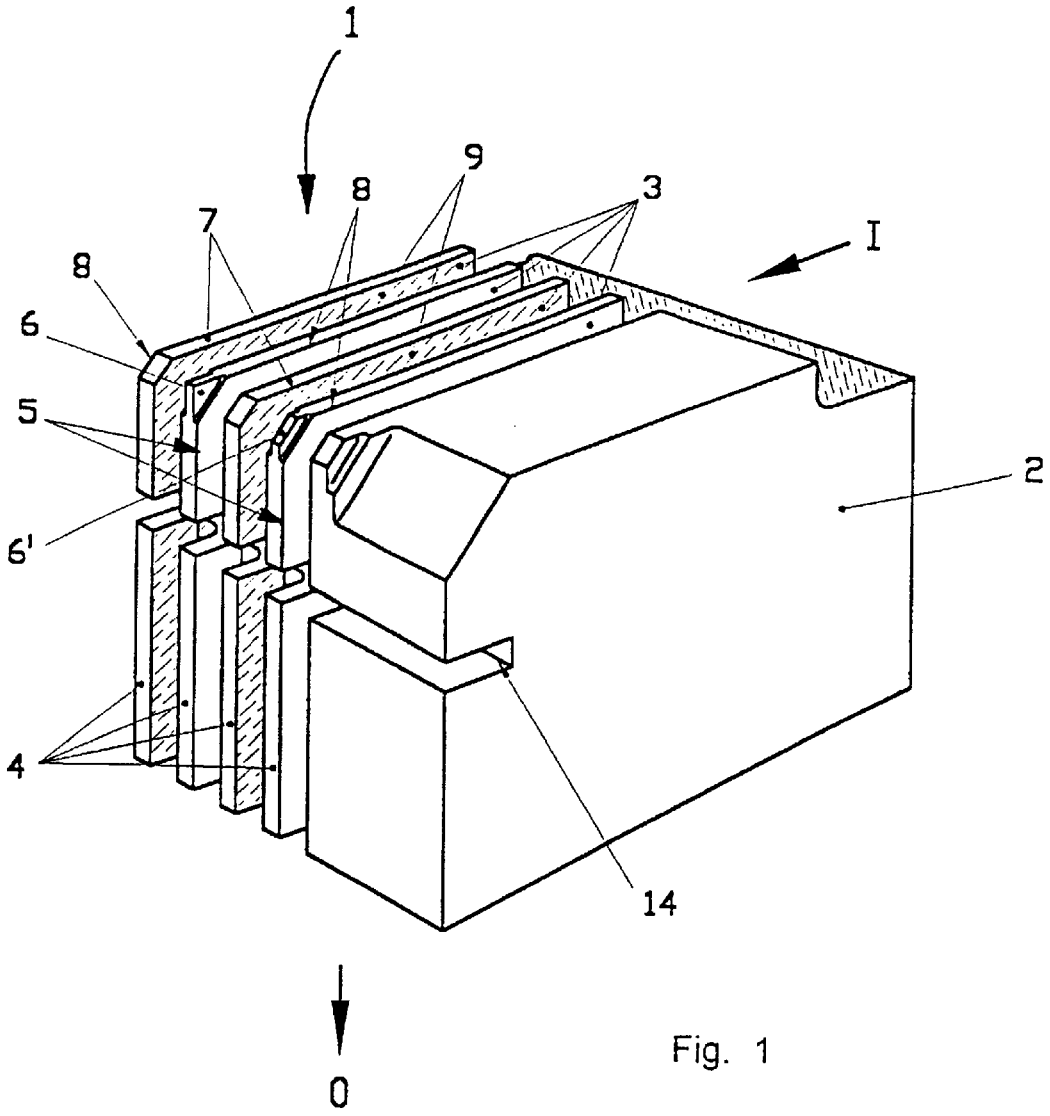
FIG. 1 is a partial perspective view of a portion of a first printhead incorporating ejection apparatus according to the present invention.

FIG. 1 illustrates part of an array-type printhead 1, the printhead comprising a body 2 of a dielectric material such as a synthetic plastics material or a ceramic. The method of operation is as described in our earlier applications mentioned above. A series of grooves 3 are machined in the body 2, leaving interposing plate-like lands 4. The grooves 3 are each provided with a ink inlet and ink outlet (not shown, but indicated by arrows I & O) disposed at opposite ends of the grooves 3 so that fluid ink carrying a material which is to be ejected (as described in our earlier applications) can be passed into the grooves and depleted fluid passed out.

Each pair of adjacent grooves 3 define a cell 5, the plate-like land or separator 4 between the pairs of grooves 3 defining (for all but the cells immediately adjacent the ends of the array) an ejection location for the material and having an ejection upstand 6. In the drawing two cells 5 are shown, the left-hand cell 5 having an ejection upstand 6 which is of generally triangular shape and the right-hand cell 5 having a truncated upstand 6'. The cells 5 are separated by a cell separator 7 formed by one of the plate-like lands 4 and the corner of each separator 7 is shaped or chamfered as shown so as to provide a surface 8 to allow the ejection upstand 6 to project outwardly of the cell beyond the exterior of the cell as defined by the chamfered surfaces 8. The truncated upstand 6' is used in the right-hand, end cell 5 of the array (and similarly in the end cell at the other end—not shown) to reduce end effects resulting from the electric fields which in turn L result from voltages applied to ejection electrodes 9 provided as metallised surfaces on the faces of the plate-like lands 4 facing the upstands 6,6' (i.e. the inner faces of each cell separator). Although the end cells are not used for ejection, the truncated upstand 6' acts to pin the liquid meniscus which in turn reduces end effects during operation, which might otherwise distort the ejection from the adjacent cell. The electrode 9 in the end cells is held at a suitable bias voltage which may be the same as a bias voltage applied to the ejection electrodes 9 in the operative cells as described in our earlier applications mentioned above. As can be seen from FIG. 3, the ejection electrodes 9 extend over the side faces of the lands 4 and the bottom surfaces 10 of the grooves 3. The precise extent of the ejection electrodes 9 will depend upon the particular design and purpose of the printer. An isolation groove 14, to provide a measure of protection against electrical shorting between adjacent cells 5, is provided in some cases, if required.

Figure 2:
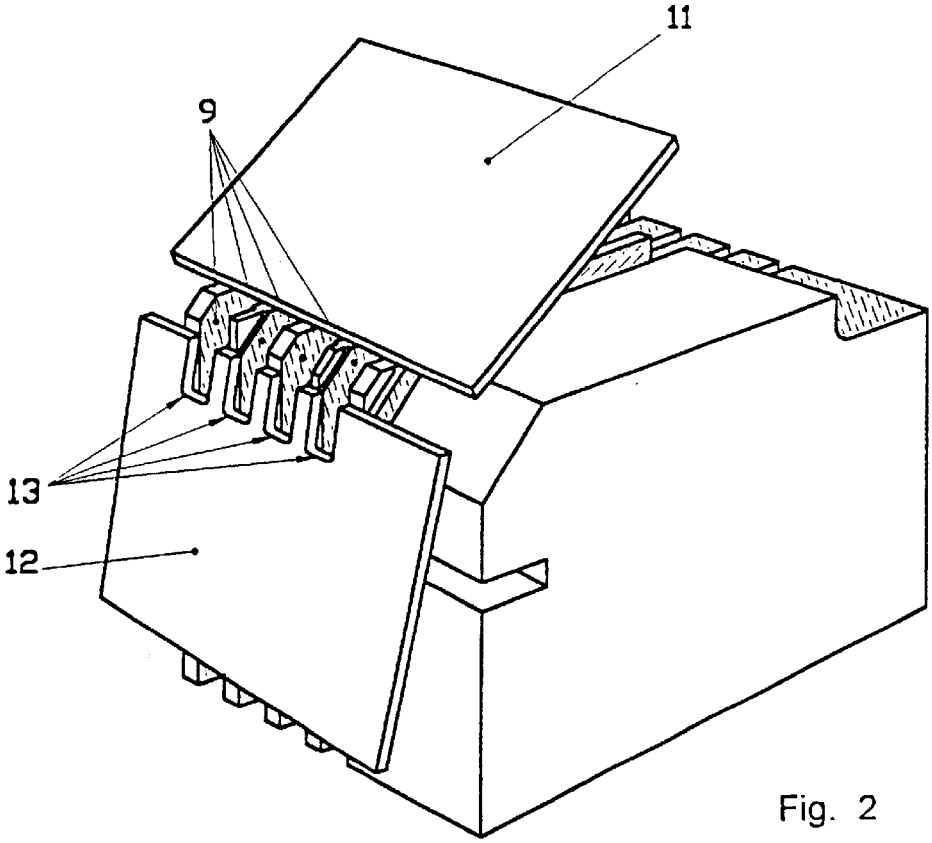
FIG. 2 is a view similar to FIG. 1 showing further and alternative features of the ejection apparatus.

FIG. 2 illustrates two alternative forms for side covers of the printer, the first being a simple straight-edged cover 11 which closes the sides of the grooves 3 along the straight line as indicated in the top part of the figure. A second type of cover 12 is shown on the lower part of the figure, the cover still closing the grooves 3 but having a series of edge slots 13 which are aligned with the grooves. This type of cover construction may be used to enhance definition of the position of the fluid meniscus which is formed in use and the covers, of whatever form, can be used to provide surfaces onto which the ejection electrode and/or secondary or additional electrodes can be formed to enhance the ejection process.

FIG. 2 also illustrates an alternative form of the ejection electrode 9, which comprises an additional metallised surface on the face of the land 4 which supports the ejection upstand 6,6'. This may help with charge injection and may improve the forward component of the electric field.

Figure 3:
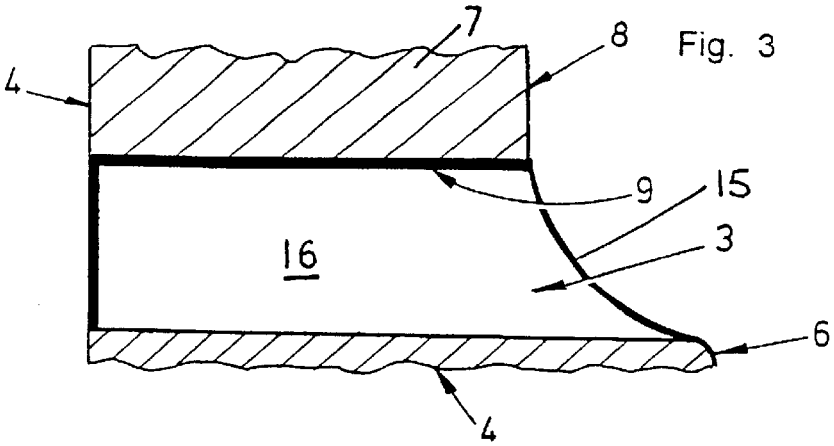
FIGS. 3 and 4 are partial sectional views through a cell of FIG. 1 and a modification thereof.
Figure 4:
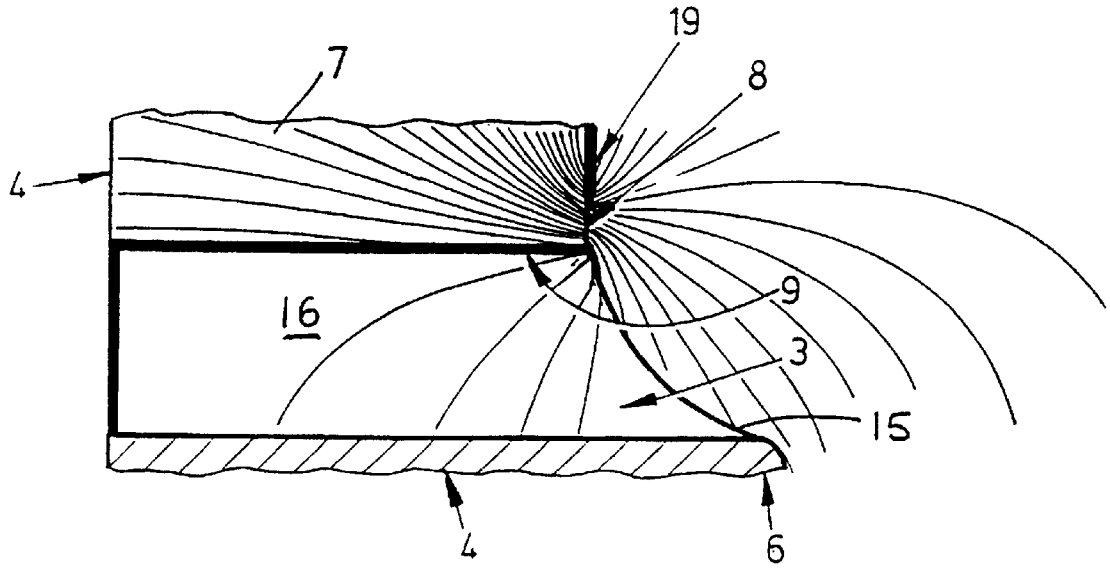

FIG. 3 illustrates a partial sectional view through one side of the one of the cells 5 of FIG. 1 and FIG. 4 an equivalent sectional view of an alternative construction which has a secondary electrode 19 on the chamfered surface 8 of the cell separator 7. Both show the meniscus 15 of liquid 16 within the cell 5.

Figure 5:
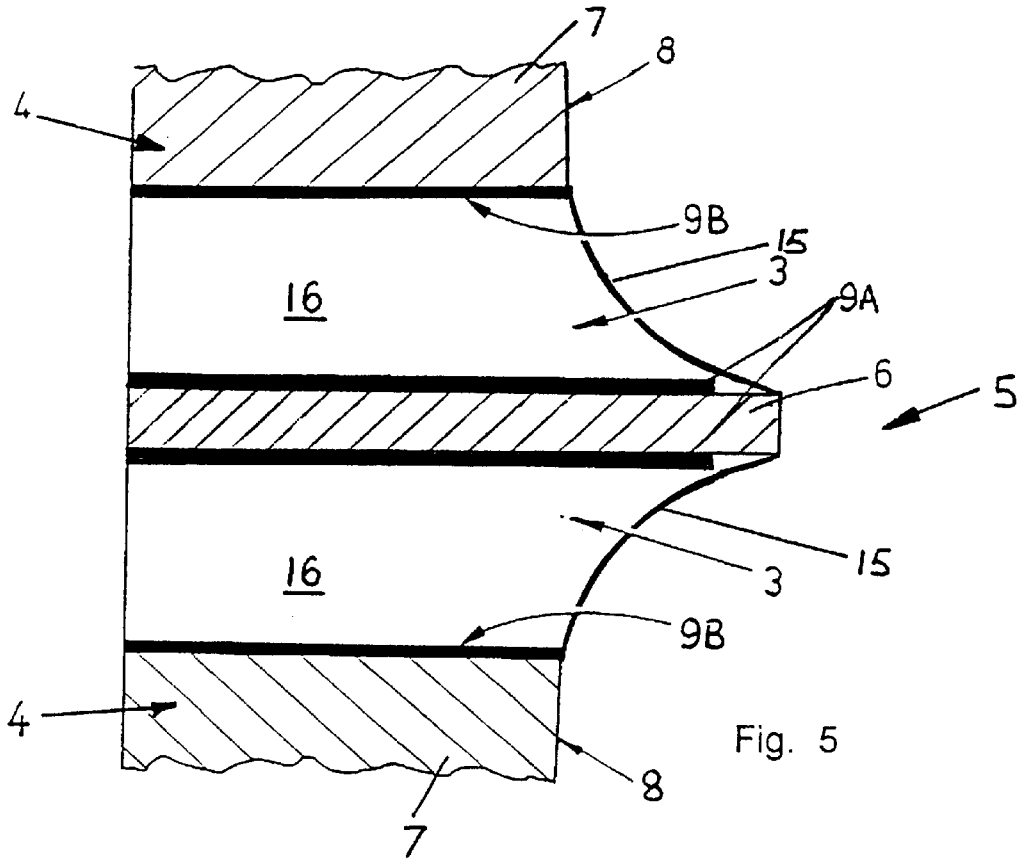
FIG. 5 illustrates a further alternative form of apparatus according to the present invention.

FIG. 5 illustrates a further example of the invention, in which the ejection electrodes are multi-part, comprising first parts 9A formed by metallised surfaces on the faces of the ejection upstands 6, 6' and second parts 9B formed by metallised surfaces on the opposing faces of the adjacent separators 7. Again the liquid and meniscus are shown at 16 and 15 respectively.

What is claimed is:

1. An ejection apparatus for ejecting material from a fluid, the apparatus comprising:

a plurality of ejection cells for containing fluid from which the material is to be ejected, each cell having a single ejection upstand formed of a dielectric material and defining allocation from which the material is ejected, and including one or more ejection electrodes disposed in the cell substantially surrounding the ejection upstand.

2. Apparatus according to claim 1, wherein the ejection electrode or electrodes extend around at least 50% of the periphery of the ejection upstand of each cell.

3. Apparatus according to claim 1, wherein the ejection electrode is a multi-part electrode.

4. Apparatus according to claim 1, wherein the side edges of the cell or cells are closed by cover plates suitably positioned.

5. Apparatus according to claim 4, wherein the cover plates constitute additional or secondary electrodes to enhance the electric field around the ejection upstands.

6. An ejection apparatus according to claim 1, wherein the ejection upstand extends outwardly of each cell, and including a pair of ejection electrodes, one disposed on each side of the ejection upstand of each cell.

7. Apparatus according to claim 6, wherein the ejection electrodes are electrically connected so as to provide the same voltages in use.

8. Apparatus according to claim 6, wherein the ejection electrodes are multi-part electrodes.

9. Apparatus according to claim 1, wherein a first part of each ejection electrode is disposed on a face of the ejection upstand and a second part on the opposing face of the adjacent separator.

10. Apparatus according to claim 6, wherein the ejection upstand, which in use pins a fluid meniscus at the outer extremity of the cell, comprises a corner of a separator which at least partially divides the cell into two halves, one on each side of the separator.

11. Apparatus according to claim 10, wherein the separator is substantially planar or plate-like and plural cells are arranged in closely spaced alignment, each cell being separated from its neighbors by a pair of second plate-like separators, one on each side whereby alternate separators are used to form the ejection upstands.

12. Apparatus according to claim 11, wherein the second separators do not project outwardly of the cells, but define the outer boundaries of the cells, through which the ejection upstands project, whereby a stack of plate-like separators define a row of ejection cells each having an ejection upstand at one corner.

13. An ejection apparatus for ejecting material from a fluid comprising:

an ejection cell for containing fluid from which the material is to be ejected, including at least one ejection upstand defining a location from which the material is ejected, and at least one ejection electrode disposed in the cell substantially surrounding the ejection upstand.

14. Apparatus according to claim 13, wherein the ejection electrode extends around at least 50% of the periphery of the ejection upstand.

15. Apparatus according to claim 13, wherein the ejection electrode is a multi-part electrode.

16. Apparatus according to claim 13, wherein the ejection upstand comprises a corner of a separator divides the cell into portions on each side of the separator.

17. Apparatus according to claim 16, wherein the separator comprises a plate-like member and plural cells are arranged in closely spaced alignment, each cell being separated from an adjacent cell by a pair of second plate-like members, one on each side whereby alternate separators are used to form the ejection upstands.

18. Apparatus according to claim 17, wherein the second separators define outer boundaries of the cells, through which the ejection upstands project, whereby a stack of plate-like separators define a row of ejection cells each having an ejection upstand at one corner.

19. Apparatus according to 18, further including cover plates suitably positioned for closing side edges of the cell.

20. Apparatus according to claim 19, wherein the cover plates comprise additional electrodes for enhancing an electric field around the ejection upstands.

* * * * *